US011676563B2

(12) United States Patent
Hamilton

(10) Patent No.: US 11,676,563 B2
(45) **Date of Patent: *Jun. 13, 2023**

(54) HEEL RAISED ADJUSTABLE DRUM PEDAL

(71) Applicant: Christopher Hamilton, Fort Worth, TX (US)

(72) Inventor: Christopher Hamilton, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/938,724

(22) Filed: Jul. 24, 2020

(65) Prior Publication Data

US 2020/0388253 A1 Dec. 10, 2020

Related U.S. Application Data

(63) Continuation-in-part of application No. 16/431,736, filed on Jun. 5, 2019, now Pat. No. 10,726,819.

(51) Int. Cl.
*G10D 13/11* (2020.01)

(52) U.S. Cl.
CPC ..... *G10D 13/11* (2020.02)

(58) Field of Classification Search
CPC ..... G10D 13/11; G10D 3/00; G10D 13/10
See application file for complete search history.

(56) References Cited

U.S. PATENT DOCUMENTS 5,458,039 A 10/1995 Ashby
6,359,205 B1 * 3/2002 Lombardi ..... G10D 13/11 84/422.1
9,162,106 B1 10/2015 Scheiman
2006/0094569 A1 * 5/2006 Day ..... A63B 22/0012 482/57

* cited by examiner

*Primary Examiner* — Kimberly R Lockett
(74) *Attorney, Agent, or Firm* — SMU Law School Patent Clinic

(57) ABSTRACT

A device may include a drum pedal board with a first end, a second end, a left side, and a right side. Further the device may include an incline section coupled to either the left side or the right side of the drum pedal board, a heel base with variable height, a hinge coupling the first end of the drum pedal board to the heel base, and a drum pedal base coupled to the heel base. The drum pedal board may be substantially parallel to the drum pedal base. The incline section may have a variable incline via a hinge. The heel base may have a variable height via a plurality of heel inserts. An adjustable strap may be operable to secure a user's foot to the drum pedal board. A raised toe section may be operable to raise an end of the drum pedal board.

14 Claims, 6 Drawing Sheets

HEEL RAISED ADJUSTABLE DRUM PEDAL

CROSS-REFERENCE TO RELATED APPLICATION

This application is a continuation-in-part of U.S. Non-Provisional patent application Ser. No. 16/431,736 filed Jun. 5, 2019, and entitled "Heel Raised Adjustable Drum Pedal", which is incorporated herein by reference in its entirety for all purposes.

TECHNICAL FIELD

The present disclosure relates to musical equipment and accessories, specifically drum pedals.

BACKGROUND

Playing a drum set is often a physically demanding endeavor. When playing a drum set, a user uses his or her foot to interact with a drum pedal to strike the bass drum.

SUMMARY

In one implementation, the present disclosure is directed to a device including a drum pedal board. The drum pedal board may have a first end, a second end, a left side, and a right side. The device may further include an incline section coupled to either the left or right side of the drum pedal board, a heel base with variable height, a first hinge coupling the first end of the drum pedal board to the heel base, and a drum pedal base coupled to the heel base. The drum pedal base may have a first end, a second end, a left side, and a right side. In various arrangements, the drum pedal board is substantially parallel to the drum pedal base at rest, the incline section is variable via a second hinge, and the heel base has variable height via a plurality of heel inserts. In some implementations, the device may have an adjustable strap operable to secure a user's foot to the drum pedal board and may also have a raised toe section operable to raise the second end of the drum pedal board. In various implementations, the raised toe section may be added or removed from the drum pedal board.

In another implementation, the present disclosure is directed to a device including a drum pedal board having a left side and a right side. The drum pedal board is operable to rotate a drum beater in response to an applied force. The device may further comprise an incline section attached to the left or the right side of the drum pedal board, a heel base, a first hinge operable to couple the drum pedal board to the heel base, and a drum pedal base coupled to the heel base. The drum pedal base has a first end and a second end. The first end of the drum pedal base is coupled to the heel base. In various arrangements, the drum pedal board is substantially parallel to the drum pedal base at rest, the incline section is variable via a second hinge, and the heel base has variable height via a plurality of heel inserts. In some implementations, the device may have an adjustable strap operable to secure a user's foot to the drum pedal board and may also have a raised toe section operable to raise an end of the drum pedal board. In various implementations, the raised toe section may be added or removed from the drum pedal board.

In yet another implementation, the present disclosure is directed to a method including applying a force to a drum pedal board that is substantially parallel to a drum pedal base coupled to and positioned below the drum pedal board, causing the drum pedal board to pivot about a hinge in the direction of the drum pedal base. The method may further include releasing the force on the drum pedal board, causing the drum pedal board to return to a position substantially parallel to the drum pedal base. In various arrangements, the method may further include positioning a user's foot in a desired location on the drum pedal board and securing the user's foot to the drum pedal board, causing a drum beater coupled to the drum pedal board to strike a bass drum in response to the drum pedal board pivoting about the hinge in the direction of the drum pedal base, supporting the user's heel via a heel base coupled to the drum pedal board, removing a heel insert from the heel base to decrease the height of the heel base, and/or adding a heel insert to the heel base to increase the height of the heel base.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
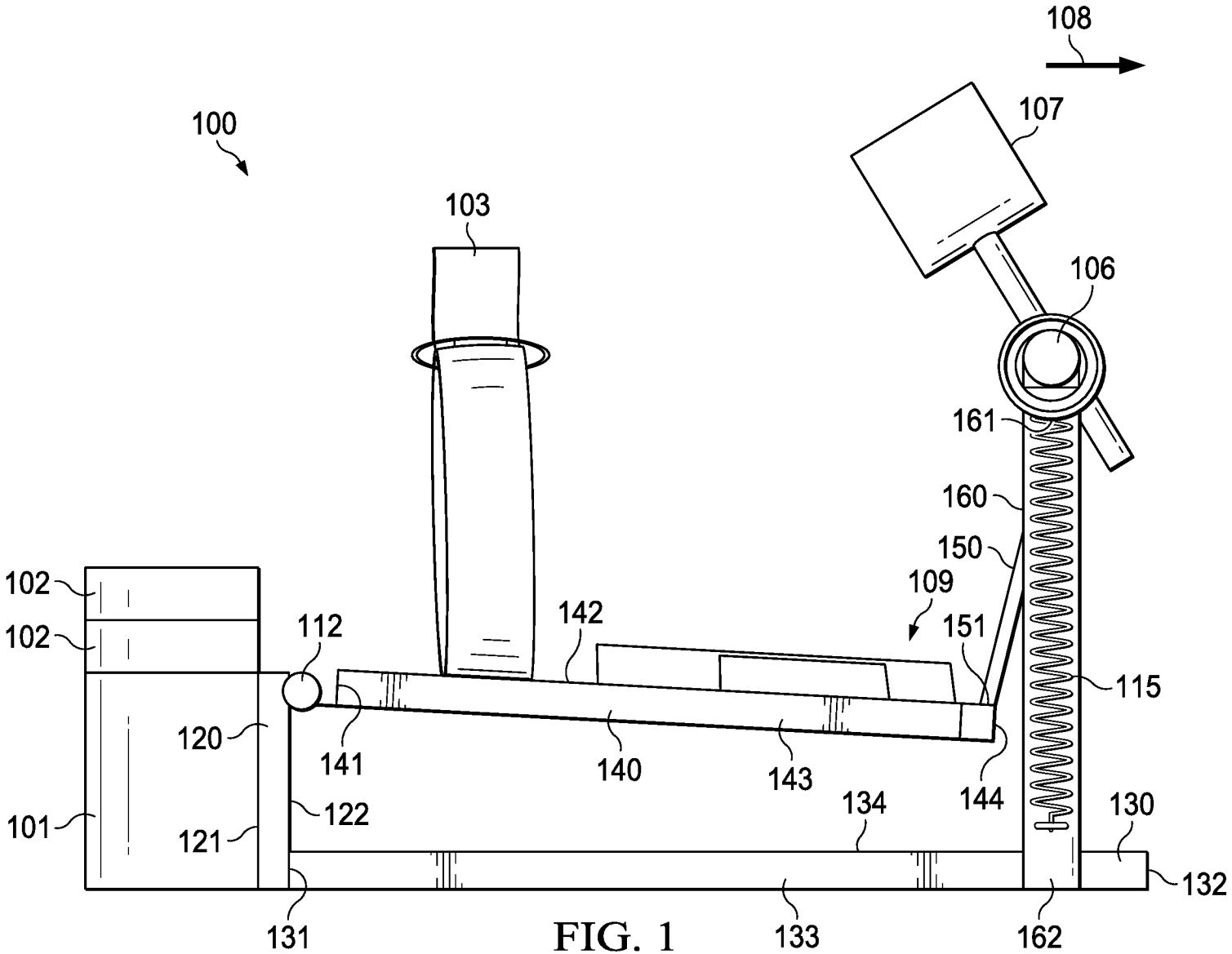
FIG. 1 illustrates a side elevation view of an implementation of a drum pedal with a raised heel base according to the present disclosure.

A traditional drum pedal has a drum pedal board with a heel portion that is lower than the top of the drum pedal board—resembling a wedge. To play a bass drum using a traditional drum pedal, a user's foot is angled upwardly from heel to toe as the user engages the drum pedal board. Because of this, traditional drum pedals can be awkward to use and may cause rapid fatigue of the user's body parts used to play the drum, such as the tibia and foot muscles. Fatigue of the user can result in mistaken timing of strikes and reduced playing time. A user may raise their heel as a solution to the problem, however the user must then support the weight of their leg while playing, which leads to further fatigue.

FIGS. 1-4 depict one implementation of a drum pedal comprising an adjustable raised heel base such that a drum pedal board and a drum pedal base are substantially parallel to one another at rest, as described in more detail herein. In the descriptions that follow, like reference numerals in the various drawings indicate like elements.

Figure 2:
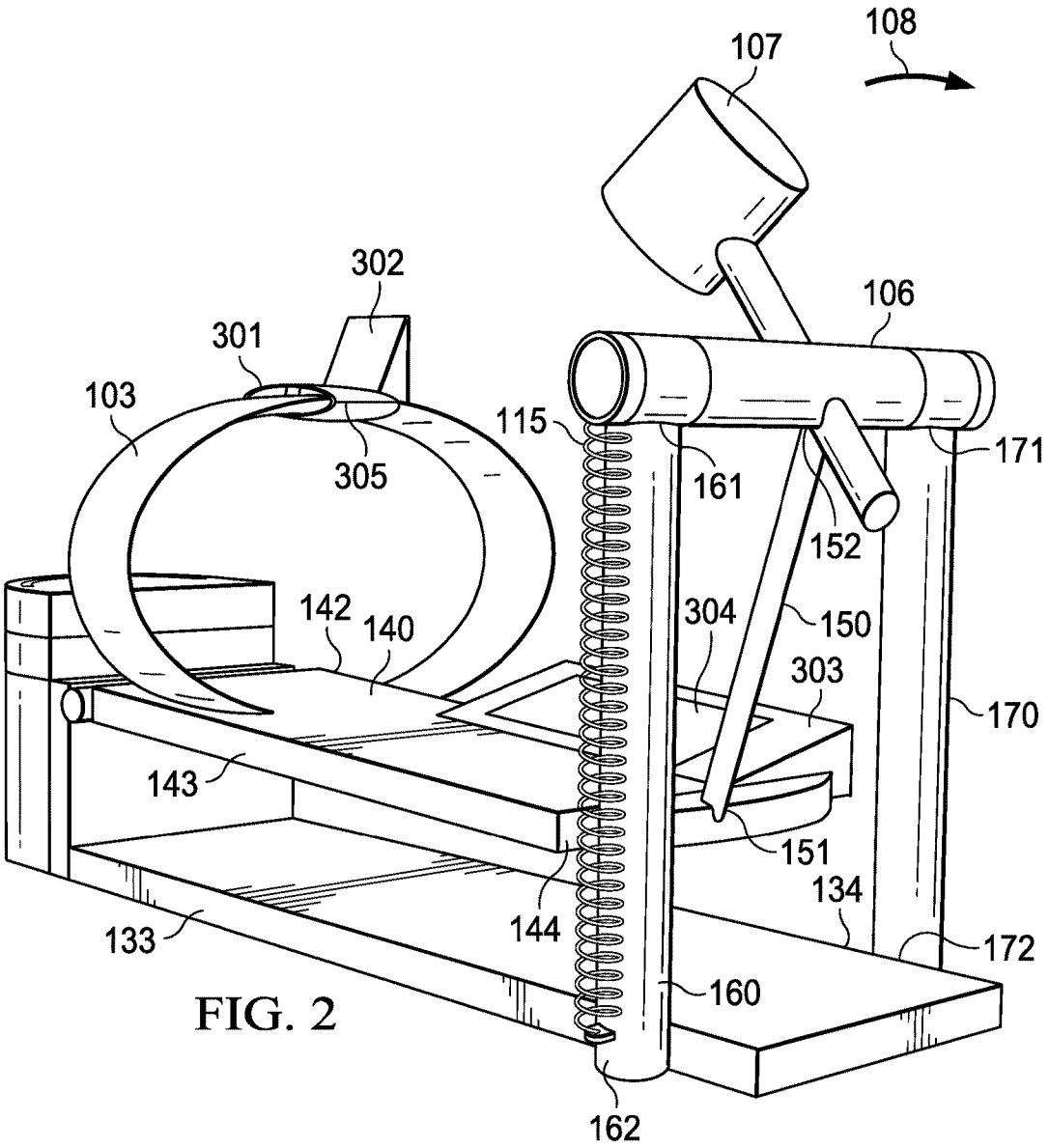
FIG. 2 illustrates a front perspective view of the drum pedal of FIG. 1 according to the present disclosure.
Figure 3:
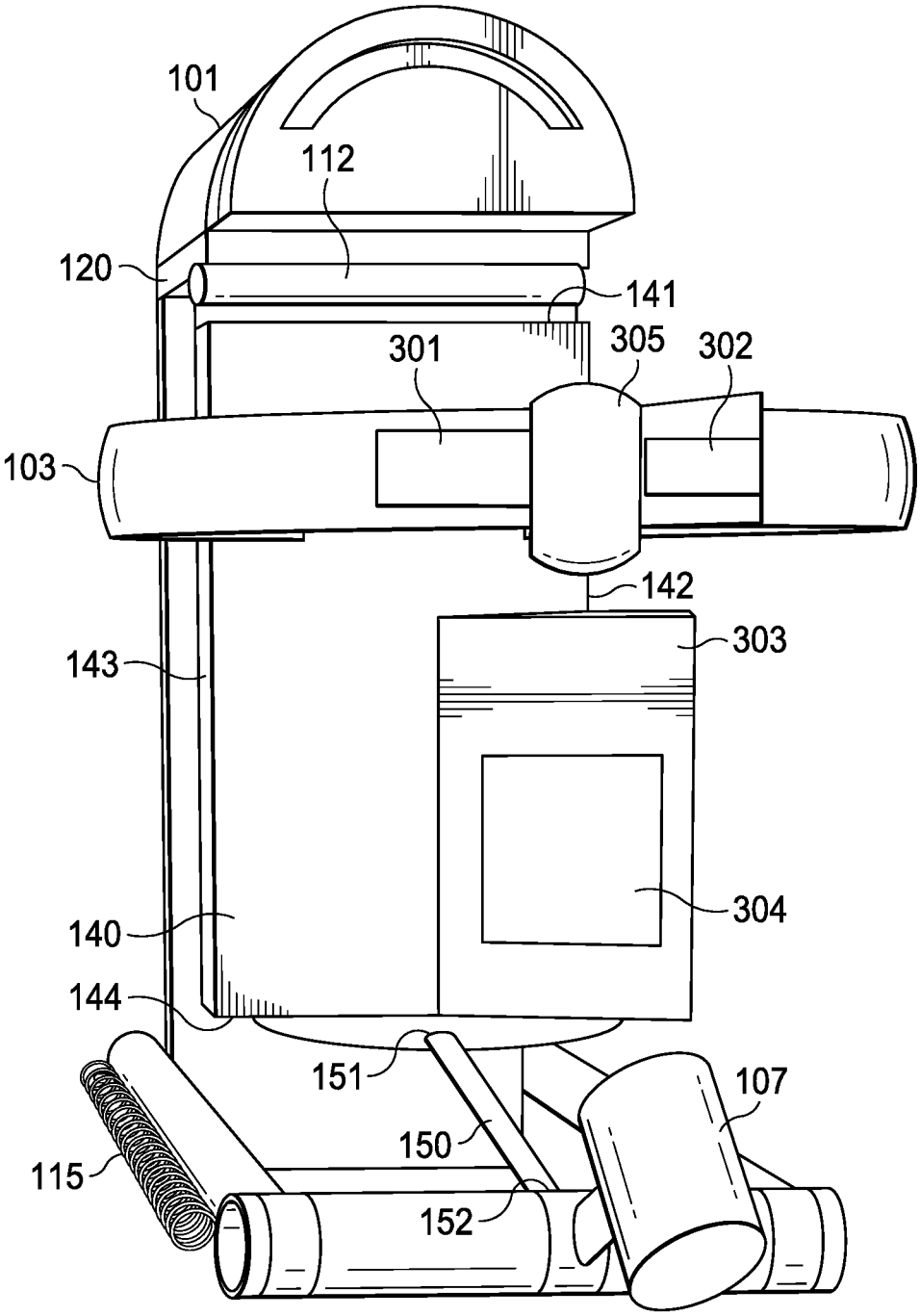
FIG. 3 illustrates a top down perspective view of the drum pedal of FIG. 1 according to the present disclosure.

FIGS. 1-3 illustrate a side elevation view, a front perspective view, and a top down perspective view, respectively, of one implementation of a heel raised adjustable drum pedal 100, according to the present disclosure. The heel raised adjustable drum pedal 100 comprises a heel base 101, which has an adjustable height via the addition or removal of a plurality of heel inserts 102, and a drum pedal board 140 positioned above, coupled to, and disposed substantially parallel to a drum pedal base 130.

The heel base 101 is coupled to one side 121 of a vertical wall 120, and one end 131 of the drum pedal base 130 is coupled to the opposite side 122 of the vertical wall 120. A first end 141 of the drum pedal board 140 is also coupled above the drum pedal base 130 to the opposite side 122 of the vertical wall 120 via a hinge 112.

The drum pedal board 140 is coupled to an optional adjustable strap 103, which comprises hook and loop fastener, 302 and 301 respectively, operable to fasten via closure 305 around the user's foot, as best shown in FIG. 2. Thus, adjustable strap 103 is operable to secure the user's foot to the drum pedal board 140. Additionally, drum pedal board 140 comprises an incline section 303 on either the left side 142 or the right side 143 of the drum pedal board 140. The incline section 303 has gripping surface 304 in one implementation of a heel raised adjustable drum pedal 100. The incline section 303 is operable to maintain the user's foot position on the drum pedal board 140. Further, in some implementations, the incline section 303 may be coupled to the drum pedal board 140 via a second hinge (not shown) to provide a variable incline, such that the incline section 303 and second hinge is operable to allow the user to select a desirable incline.

A second end 144 of the drum pedal board 140 is coupled to a first end 151 of a chain 150 opposite heel base 101. A second end 152 of chain 150 is coupled to a drum beater holder 106 that is supported by and spans between a top end 161 of a first column 160 and a top end 171 of a second column 170, as best shown in FIG. 2. A drum beater 107 is coupled to the drum beater holder 106. A bottom end 162 of first column 160 is coupled to one side 133 of drum pedal base 130, and similarly, a bottom end 172 of second column 170 is coupled to an opposite side 134 of drum pedal base 130. Spring 115 is connected to drum beater holder 106 and connected to column 160. Alternatively, spring 115 is connected to drum beater holder 106 and connected to second column 170. In various embodiments, the spring 115 may be connected to the inside or the outside of either of the columns 160, 170, such as at or near the bottom end 162 of the first column 160 as shown in FIGS. 1-3, or at or near the bottom end 172 of the second column 170, or to another location along either of the columns 160, 170.

Referring again to FIG. 1, drum pedal board 140 and drum pedal base 130 are disposed in a substantially parallel fashion when the heel raised adjustable drum pedal 100 is at rest. By applying downward force on drum pedal board 140, hinge 112 is operable to allow drum pedal board 140 to pivot in a downward direction towards drum pedal base 130, as indicated by movement arrow 109.

Depressing drum pedal board 140 in the direction of arrow 109 pulls chain 150 and creates tension on spring 115. Because chain 150 is coupled to drum beater holder 106, pulling chain 150 causes the drum beater holder 106 to rotate, which in turn causes drum beater 107 to pivot away from the heel raised adjustable drum pedal 100, as indicated by movement arrow 108. Releasing drum pedal board 140 in the opposite direction of arrow 109 releases tension of spring 115. Because spring 115 is coupled to drum beater holder 106, releasing tension on spring 115 causes drum beater holder 106 to rotate in the reverse direction, which in turn causes drum beater 107 and chain 150 to both return to their starting positions. Chain 150 may be a chain, strap, direct drive shaft, rope, wire, wire coated material, Nylon strap, rubber strap, plastic strap, plastic chain or any other connecting device capable of coupling the drum pedal board 140 to the drum beater holder 106 and causing the drum beater holder 106 to rotate in response to a downward force exerted on the drum pedal board 140.

The heel base 101 is operable to elevate and support a user's heel, while at least a portion of the user's foot engages the drum pedal board 140. The plurality of heel inserts 102 allow the height of the heel base 101 to be variable.

Figure 4:
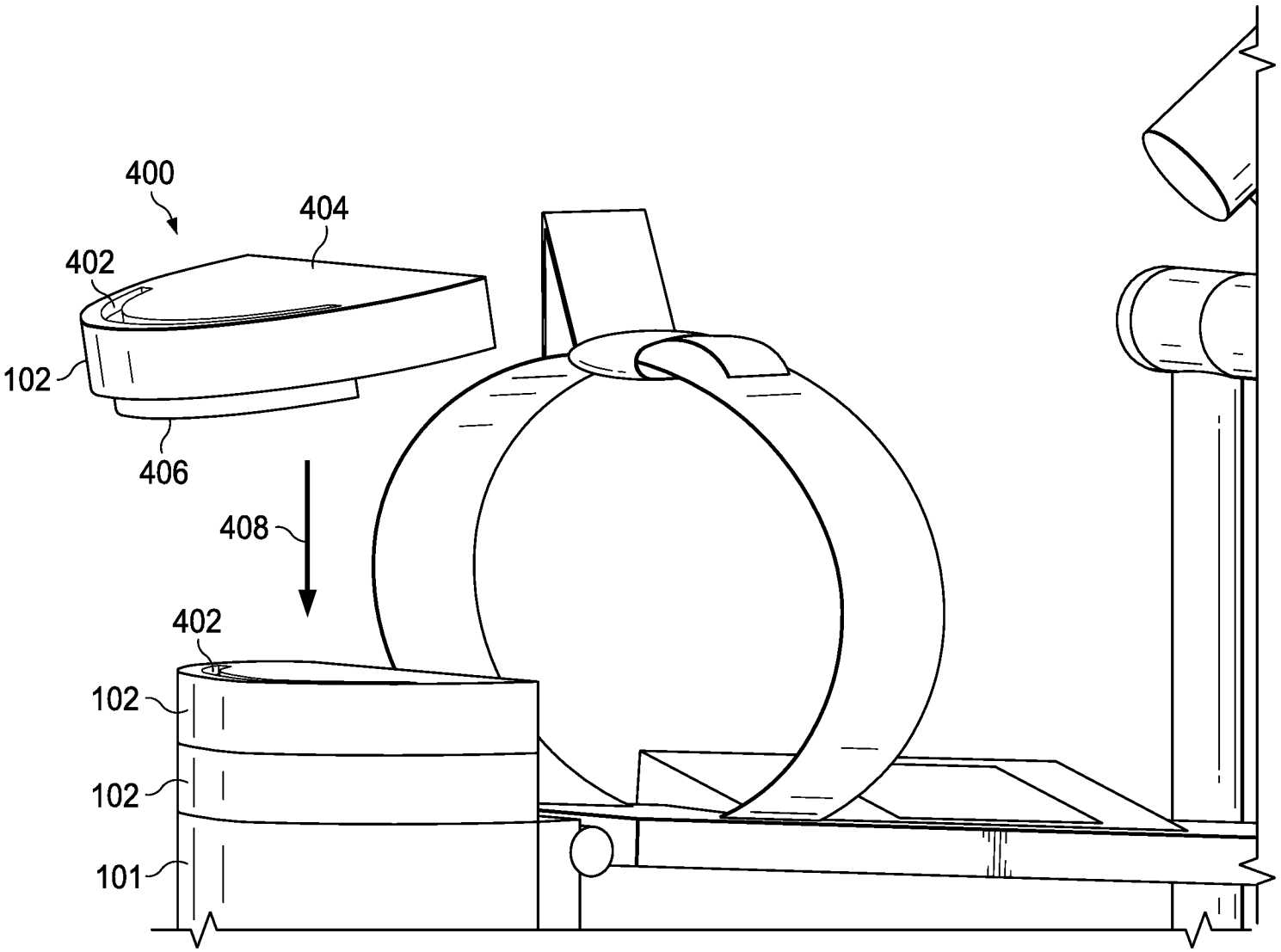
FIG. 4 illustrates a variable height of a heel base of the drum pedal of FIG. 1 via heel inserts according to the present disclosure.

FIG. 4 illustrates, in more detail, how to vary the height of the heel base 101 of the heel raised adjustable drum pedal 100 of FIGS. 1-3 via heel inserts 102. As previously disclosed, heel base 101 has variable height via the addition or removal of heel inserts 102. In one implementation, a heel insert 102 comprises a semicircular body 400 having a recessed cutout 402 on an upper surface 404 thereof and a protrusion 406 extending downwardly from the semicircular body 400.

The heel inserts 102 are designed to be stackable. To increase the height of heel base 101, the recessed cutout 402 from one heel insert 102 is operable to accept protrusion 406 from another heel insert 102 that is being added to the stack, as indicated by movement arrow 408. Thus, in the present implementation, movement arrow 408 indicates the addition of a heel insert 102 to the heel base 101 via coupling protrusion 406 of the heel insert 102 with the recessed cutout 402 of the uppermost heel insert 102 on the heel base 101. To decrease the height of heel base 101, at least one heel insert 102 is removed from the heel base 101, such that the protrusion 406 of the heel insert 102 being removed is uncoupled from the recessed cutout 402 of the uppermost heel insert 102 that remains stacked on the heel base 101. As depicted, heel inserts 102 are operable to vary the height of heel base 101 to the personalized desire of a user seeking to minimize fatigue while operating a heel raised adjustable drum pedal 100.

Figure 5:
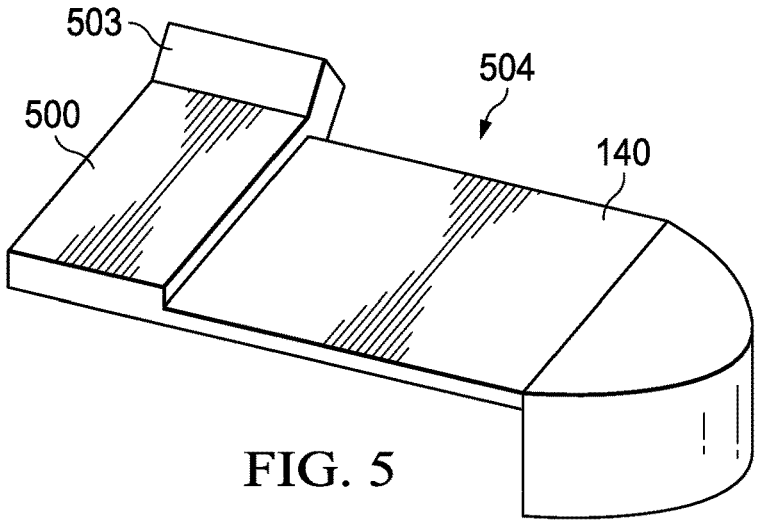
FIG. 5 illustrates a perspective view of another implementation of a drum pedal board that includes a raised toe section according to the present disclosure.

FIG. 5 illustrates a perspective view of another implementation of a drum pedal board 504 that may be used in place of the drum pedal board 140 in the heel raised adjustable drum pedal 100 introduced in FIGS. 1-3. In more detail, drum pedal board 504 may comprise a raised toe section 500 that includes an integrated incline section 503. In various implementations, drum pedal board 504 may be manufactured to comprise the raised toe section 500, or the raised toe section 500 may be a separate component removably coupled to drum pedal board 504. In yet another implementation, raised toe section 500 is a separate component, does not comprise incline section 503, and may removably couple to the drum pedal board 140 introduced in FIGS. 1-3. In this implementation, incline section 303 introduced in FIG. 3 is utilized instead. Raised toe section 500 is operable to raise an end of the drum pedal board where the toe end of the user's foot engages the drum pedal board 504, 140.

Figure 6:
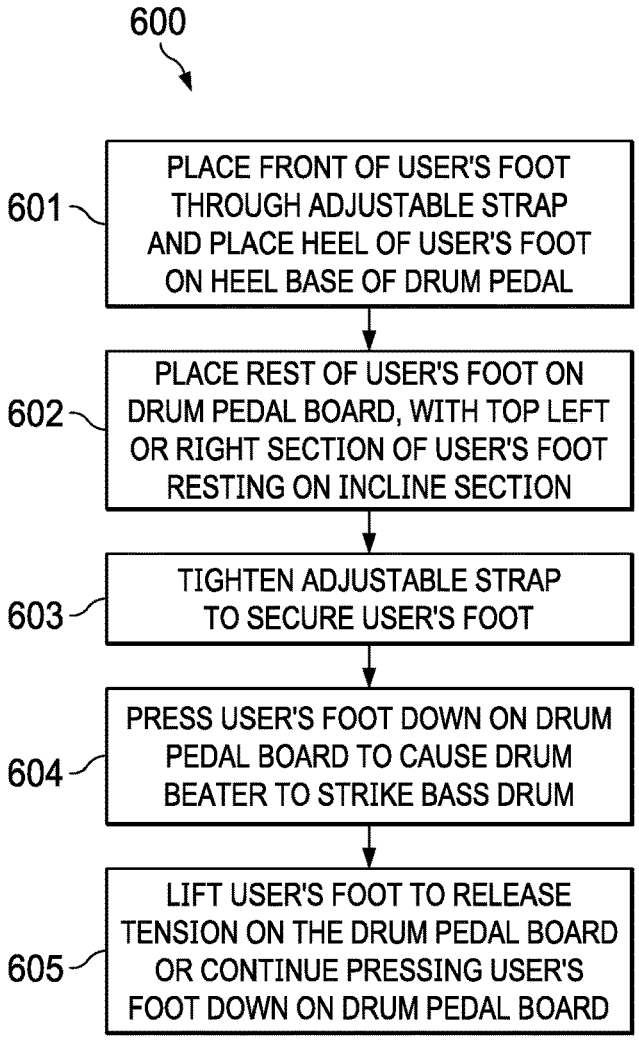
FIG. 6 illustrates a flowchart of an implementation of a method of playing a drum pedal according to the present disclosure.

FIG. 6 illustrates a flowchart of an implementation of a method of playing 600 a heel raised adjustable drum pedal 100 as introduced in FIGS. 1-5. In one implementation, method 600 includes the steps 601-605. Step 601 comprises placing the front of a user's foot through adjustable strap 103 and then resting the user's heel on heel base 101 of heel raised adjustable drum pedal 100. In step 601, adjustable strap 103 may be a hook and loop fastener or any other over-the-foot fastener. Step 602 comprises placing the rest of the user's foot on the drum pedal board 140, 504 and resting the top left or the top right section of the user's foot on incline section 303, 503 of drum pedal board 140, 504 depending on whether the incline section 303, 503 is positioned on the left or right side of the drum pedal board 140, 504. Step 603 comprises tightening adjustable strap 103, such as by fastening the fabric strip of hooks 302 to the fabric strip of loops 301. In step 603, adjustable strap 103 may be a hook and loop fastener or any other over-the-foot fastener. Step 604 comprises pressing downwardly via the user's foot on the drum pedal board 140, which pulls chain 150. Chain 150 creates tension on spring 115, causing drum beater holder 106 to rotate drum beater 107 forward, striking the bass drum. Step 605 comprises either releasing tension on the drum pedal board 140, 504 or continuing to hold tension on the drum pedal board 140, 504. Method 600 may be repeated to achieve the desired tune by returning to step 604 after completing steps 601-605. Method 600 may include all or some of the steps 601, 602, 603, 604, and 605. In one implementation, method 600 may include more steps than those disclosed in the present application.

Figure 7:
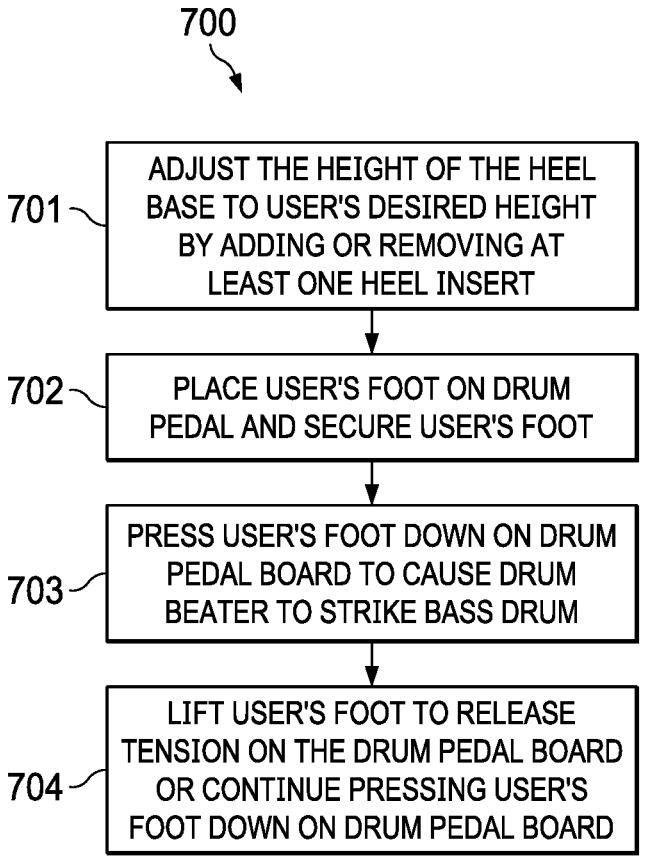
FIG. 7 illustrates a flowchart of another implementation of a method of playing a drum pedal according to the present disclosure.

FIG. 7 illustrates a flowchart of an implementation of another method of playing 700 a heel raised adjustable drum pedal. In one implementation, method 700 includes the steps 701-704. Step 701 comprises adjusting the height of heel base 101 to a desired height for a user by adding or removing at least one heel insert 102. Step 702 comprises positioning the user's foot in a desired location on the drum pedal board 140, 504 and optionally securing the user's foot to drum pedal board 140, 504. Step 703 comprises applying downward force to the drum pedal board 140, 504 which is initially substantially parallel to a drum pedal base 130 coupled to and positioned below the drum pedal board 140, 504. Step 703 further comprises causing the drum pedal board 140, 504 to pivot about hinge 112 in the direction of drum pedal base 130. Step 704 comprises releasing the force on drum pedal board 140, 504 causing the return of drum pedal board 140, 504 to a position substantially parallel to drum pedal base 130 or continuing to hold tension on the drum pedal board 140, 504. Method 700 may be repeated to achieve the desired tune by returning to step 703 after completing steps 701-04. Method 700 may include all or some steps 701, 702, 703, 704. In one implementation, method 700 may include more steps than those disclosed in the present application.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular implementations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding implementations described herein may be utilized according to the present disclosure. Accordingly, the appended claims are intended to include within their scope such processes, machines, manufacture, compositions of matter, means, methods, or steps.

The invention claimed is:

1. A device, comprising:

a drum pedal board with a first end, a second end, a left side, and a right side;

an incline section coupled to said left side or said right side of said drum pedal board;

a heel base, said heel base having a variable height;

a first hinge coupling said first end of said drum pedal board to said heel base; and a drum pedal base comprising a first end, a second end, a left side, and a right side;

wherein said first end of said drum pedal base is coupled to said heel base.

2. The device of claim 1, wherein:

said drum pedal board is substantially parallel to said drum pedal base at rest.

3. The device of claim 1, wherein:

said incline section has a variable incline via a second hinge.

4. The device of claim 1, wherein:

said heel base has a variable height via a plurality of heel inserts.

5. The device of claim 1, further comprising:

an adjustable strap operable to secure a user's foot to said drum pedal board.

6. The device of claim 1, further comprising:

a raised toe section operable to raise the second end of the drum pedal board.

7. The device of claim 6, wherein the raised toe section may be added or removed from the drum pedal board.

8. A device, comprising:

a drum pedal board with a left side and a right side, said drum pedal board operable to rotate a drum beater in response to an applied force;

an incline section coupled to said left side or said right side of said drum pedal board;

a heel base;

a first hinge operable to couple said drum pedal board to said heel base; and a drum pedal base comprising a first end and a second end;

wherein said first end of drum pedal base is coupled to said heel base.

9. The device of claim 8, wherein:

said drum pedal board is substantially parallel to said drum pedal base at rest.

10. The device of claim 8, wherein:

said incline section has a variable incline via a second hinge.

11. The device of claim 8, wherein:

said heel base has a variable height via a plurality of heel inserts.

12. The device of claim 8, wherein:

an adjustable strap operable to secure a user's foot to said drum pedal board.

13. The device of claim 8, further comprising:

a raised toe section operable to raise an end of the drum pedal board.

14. The device of claim 13, wherein the raised toe section may be added or removed from the drum pedal board.

* * * * *